US007381035B2

(12) United States Patent
Riney

(10) Patent No.: US 7,381,035 B2
(45) Date of Patent: Jun. 3, 2008

(54) PISTON PUMP WITH CHECK SHAFT

(75) Inventor: John Matthew Riney, Buford, GA (US)

(73) Assignee: Nordson Corporation, Westlake, OH (US)

( * ) Notice: Subject to any disclaimer, the term of this patent is extended or adjusted under 35 U.S.C. 154(b) by 415 days.

(21) Appl. No.: 11/056,025

(22) Filed: Feb. 11, 2005

(65) Prior Publication Data

US 2005/0232797 A1 Oct. 20, 2005

Related U.S. Application Data

(60) Provisional application No. 60/562,145, filed on Apr. 14, 2004.

(51) Int. Cl.
*F04B 49/00* (2006.01)

(52) U.S. Cl. ..... 417/511; 417/387; 417/390; 417/443; 417/510; 417/545; 417/570

(58) Field of Classification Search ..... 417/387, 417/390, 443, 510, 511, 570, 545
See application file for complete search history.

(56) References Cited

U.S. PATENT DOCUMENTS 3,259,077 A * 7/1966 Wiley et al. ..... 417/505
4,240,329 A * 12/1980 Inhofer et al. ..... 91/342
4,638,924 A * 1/1987 Newsom ..... 222/1
4,761,118 A * 8/1988 Zanarini ..... 417/254
5,499,745 A 3/1996 Derian et al. ..... 222/136
6,155,806 A 12/2000 Andel ..... 417/523
6,212,997 B1 4/2001 McCollough et al. ..... 92/155
2003/0143091 A1 * 7/2003 Dong ..... 417/418
2004/0029980 A1 2/2004 Stumphauzer et al. ..... 516/31

* cited by examiner

*Primary Examiner*—Devon Kramer
*Assistant Examiner*—Leonard J Weinstein
(74) *Attorney, Agent, or Firm*—Wood, Herron & Evans, LLP

(57) ABSTRACT

A pump for use with a dispensing unit of a liquid hot melt adhesive system, dispensing units including the pump, and a method of operating a pump for pumping a liquid like liquid hot melt adhesive. The pump has a piston movable within a pumping chamber for transferring liquid from an inlet to an outlet. A valve body, which is resiliently biased relative to the piston, is moved out of contact with the inlet when the piston moves in a first direction and into contact with the inlet when the piston moves in a second direction. When the piston is moved in the first direction, the resilient biasing actively lifts the valve body out of contact with the inlet for overcoming any attractive adhesive force acting between the valve body and inlet.

15 Claims, 3 Drawing Sheets

PISTON PUMP WITH CHECK SHAFT

CROSS REFERENCE TO RELATED APPLICATIONS

This application claims the benefit of U.S. Provisional Application No. 60/562,145, filed Apr. 14, 2004, which is hereby incorporated by reference herein in its entirety.

FIELD OF THE INVENTION

The present invention pertains to dispensing systems for dispensing flowable materials, and more particularly to piston pumps for such dispensing systems.

BACKGROUND OF THE INVENTION

Hot melt adhesive dispensing systems generally include a dispenser coupled with one or more dispensing guns, heated hoses fluidly connected to the dispensing guns, and a dispensing unit for melting and supplying heated liquid adhesive to the guns through the heated hoses. The dispensing units of conventional hot melt adhesive systems feature a heated tank for melting and heating adhesive material received into the tank in solid or semi-solid form, a pump, a pump manifold for pumping the molten hot melt adhesive from the tank to outlet ports coupled with the heated hoses, and a controller. Among other system operations, the controller regulates the power supplied to the tank heater and heated hoses to maintain the liquid adhesive at an appropriate viscosity and temperature, depending on the application.

Traditional hot melt adhesives are thermoplastic adhesives that are widely used in industry for adhesively bonding many diverse types of products. Such traditional thermoplastic adhesives are solid at room temperature and must be heated to cause a phase transition to a liquid or semi-solid state for promoting flowability and dispensability. In contrast to traditional thermoplastic adhesives, liquid hot melt adhesives have been recently developed that exist in a flowable form at room or ambient temperature without heating to precipitate a phase transition.

Liquid hot melt adhesives are characterized by properties that differ significantly from the properties of traditional hot melt materials. Traditional hot melt materials are converted from a room temperature solid to a flowable form in a heated melter and subsequently pumped through a heated hose to a heated manifold and applicator or gun. In contrast, liquid hot melt adhesives are flowable and have a relatively low viscosity at ambient or room temperatures and pressures, form a highly viscous material with adhesive properties similar to traditional hot melt materials when activated by, for example, exposure to elevated temperatures and/or pressures, and solidify upon cooling after being applied to a substrate. The activated and solidified material behaves like a traditional thermoplastic hot melt adhesive and possesses similar bonding characteristics. An exemplary liquid hot melt adhesive, which is disclosed in U.S. Patent Application Publication No. 2004/0029980, consists of discrete particle components dispersed in a carrier fluid and is heat activated.

Liquid hot melt adhesives may be activated by, for example, heating shortly before being dispensed from the dispensing gun(s) onto a substrate. The activation may occur at or near the dispensing gun. Alternatively, the activation may occur at any location between the tank and dispensing gun sufficiently close to the dispensing gun so that the viscosity of the activated liquid hot melt adhesive remains low enough to permit flow from the activation site to the dispensing gun. Although liquid hot melt adhesive is not heated at the tank as are traditional thermoplastic adhesives, adhesive dispensing systems nonetheless require a pump, such as a piston pump, for pumping the liquid hot melt adhesive in a nonactivated state from the tank to the dispensing guns.

One difficulty observed when pumping liquid hot melt adhesives and, for that matter, when pumping other traditional thermoplastic adhesives, is that these materials tend to coagulate and form a solid tacky coating on moving components located in the liquid path inside the pump. The residual coating may adversely affect the operation of these moving components and, hence, pump operation. The balls of pump check valves are one type of moving component particularly affected by the formation of these coatings. A coated check valve ball may tend to adhere and stick to its seat, which makes pumping inefficient. Eventually, the presence of the coating may result in a total pump failure that may be remedied only by completely disassembling and cleaning the pump to remove the coating.

A need therefore exists for a dispensing unit of a hot melt adhesive dispensing system having a pump equipped with moving components resistant to the adverse effects of coating by coagulated liquid hot melt adhesive as described above.

SUMMARY OF THE INVENTION

The present invention provides a device for use in dispensing a liquid, such as a liquid hot melt adhesive. The device includes a pump housing having an inlet, an outlet, and a pumping chamber between the inlet and outlet. A piston is slidably disposed within the pump housing for movement in a first direction for admitting an amount of the liquid into the pumping chamber through the inlet. Moving the piston in a second direction pumps the amount of the adhesive from the pumping chamber through the outlet. A valve body is coupled with the piston for closing the inlet when the piston is moved in the second direction. The valve body is disengaged from the inlet to open the inlet for admitting the amount of liquid into the pumping chamber when the piston is moved in the first direction. The valve body is engaged with the inlet to close the inlet when the piston is moved in the second direction.

In another embodiment of the present invention, a device for use in dispensing a liquid, such as a liquid hot melt adhesive, includes a pump housing having first and second inlets, first and second outlets, a first pumping chamber between the first inlet and the first outlet, and a second pumping chamber between the second inlet and the second outlet. A piston is slidably disposed within the pump housing between the first and second pumping chambers. The piston is movable in a first direction for admitting a first amount of the liquid into the first pumping chamber through the first inlet and pumping a second amount of the liquid from the second pumping chamber from the second outlet. The piston is movable in a second direction for pumping the first amount of the liquid in the first pumping chamber from the first outlet and admitting the second amount of the liquid into the second pumping chamber. First and second valve bodies are coupled with the piston. The first valve body is disengaged from the first inlet to open the first inlet for admitting the amount of liquid into the first pumping chamber when the piston is moved in the first direction and being engaged with the first inlet to close the first inlet when the piston is moved in the second direction. The second valve body is disengaged from the second inlet to open the second inlet for admitting the amount of liquid into the second pumping chamber when the piston is moved in the second direction and is engaged with the second inlet to close the second inlet when the piston is moved in the first direction.

In another aspect, a method of operating a pump for dispensing a liquid includes moving a piston in a first direction to admit an amount of the liquid into a pumping chamber through an inlet to the pumping chamber. The method further includes resiliently biasing a valve body relative to the piston to disengage the valve body from the inlet as the piston moves in the first direction and thereby open the inlet for admission of the amount of the liquid. The method may further include moving the piston in a second direction to discharge the amount of the liquid from an outlet of the pumping chamber and applying a biasing force between the piston and a valve body to engage the valve body with the inlet as the piston moves in the second direction.

These and other features, advantages and objectives of the invention will become more readily apparent to those of ordinary skill in the art upon review of the following detailed description of the preferred embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the details of the preferred embodiments.

DETAILED DESCRIPTION

Figure 1:
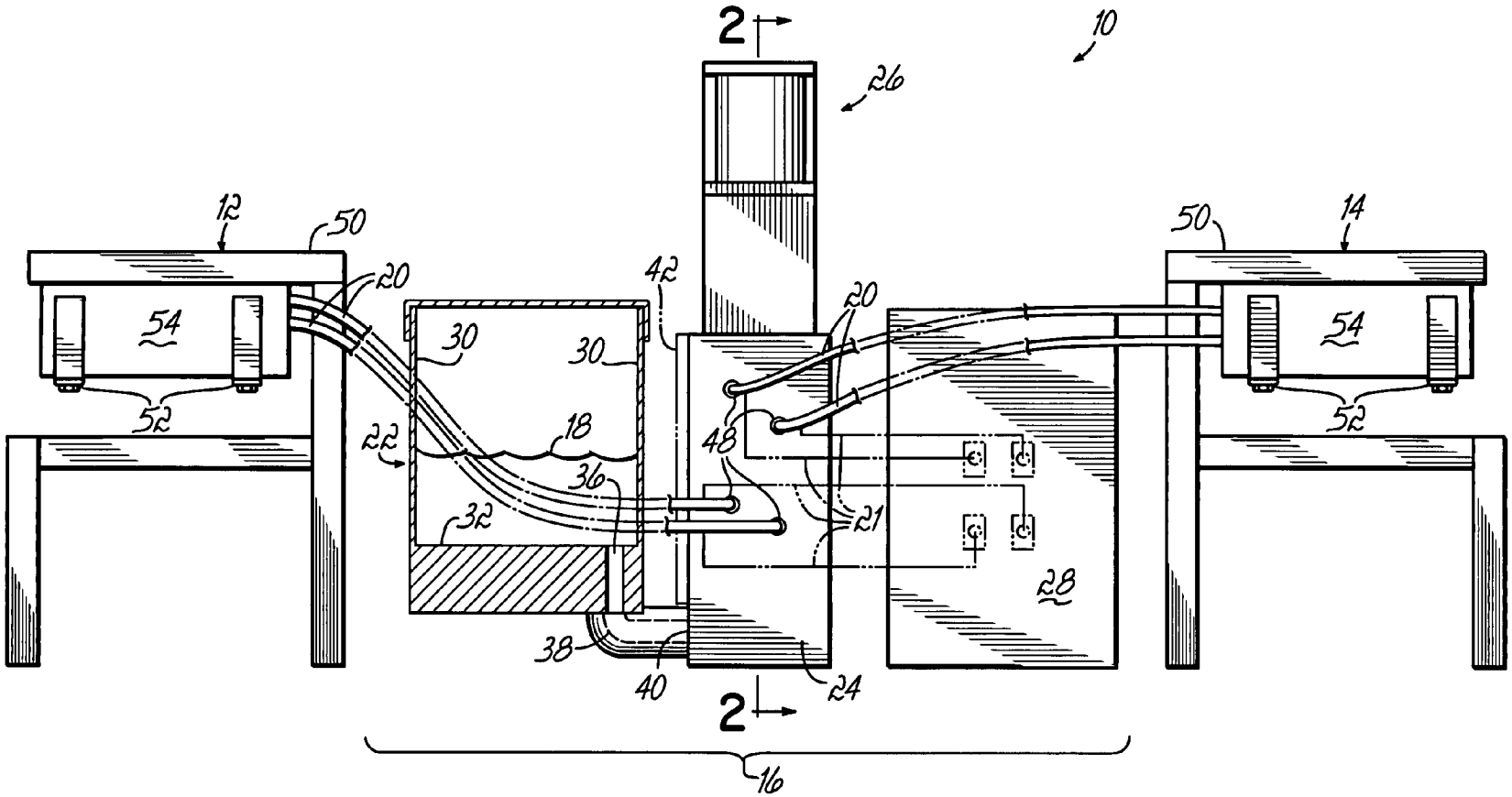
FIG. 1 is a schematic drawing of an adhesive dispensing system, including a dispensing unit having a pump according to the present invention.

Referring to FIG. 1, an adhesive dispensing system 10 includes a pair of guns 12, 14, a dispensing unit 16 for supplying liquid hot melt adhesive 18 to the guns 12, 14, and hoses 20 connecting the dispensing unit 16 to the guns 12, 14. The dispensing unit 16 includes a reservoir, such as tank 22, holding a volume of liquid hot melt adhesive 18, a manifold 24 in fluid communication with the tank 22, a pump 26 constructed according to the principles of the present invention and coupled to the manifold 24, and a controller 28. The tank 22 comprises side walls 30 joined by a base 32 that collectively define the reservoir holding the adhesive 18. A tank outlet 36 proximate the base 32 is coupled to a passage 38 that connects to an inlet 40 of the manifold 24.

The manifold 24 may optionally include a manifold heater 42 operationally controlled by controller 28 for heating the liquid hot melt adhesive 18 while resident inside manifold 24. The tank 22 may optionally include a tank heater (not shown) controlled by controller 28 for raising the temperature of the liquid hot melt adhesive 18 while resident in the tank 22. Optionally, hoses 20 may be configured to be heated and cord sets 21, also operationally controlled by controller 28, may be used for heating and controlling the temperature of hoses 20 in a known manner.

Pump 26, which is coupled to the manifold 24, pumps liquid hot melt adhesive 18 from the tank 22 into the manifold 24. Manifold 24 divides the adhesive 18 into separate flows and directs the distinct flows to a plurality of outlet ports 48. The outlet ports 48 are configured to be coupled to the hoses 20 whereby the liquid adhesive 18 is supplied through hoses 20 to the guns 12, 14. The guns 12, 14, which may be mounted to a frame 50, include one or more modules 52 that apply the adhesive 18 to a desired product (not shown). Modules 52 may be coupled to their own individual manifolds 54 for supplying liquid hot melt adhesive 18, actuating air, and process air thereto. Although system 10 illustrates two gun manifolds 54, additional hoses (not shown) identical to hose 20 may transfer liquid hot melt adhesive 18 to additional gun manifolds (not shown) identical to manifold 54 that are located respectively behind manifolds 54. Other systems 10 may have a single gun, or may have other guns, like guns 12, 14 and, furthermore, the guns 12, 14 may take on many different configurations, according to the particular adhesive dispensing requirements, without departing from the spirit and scope of the invention. The guns 12, 14 and/or the gun manifolds 54 may each incorporate heat exchanger/mixers and heaters (not shown) for blending and/or elevating the temperature of the liquid hot melt adhesive 18.

Figure 2:
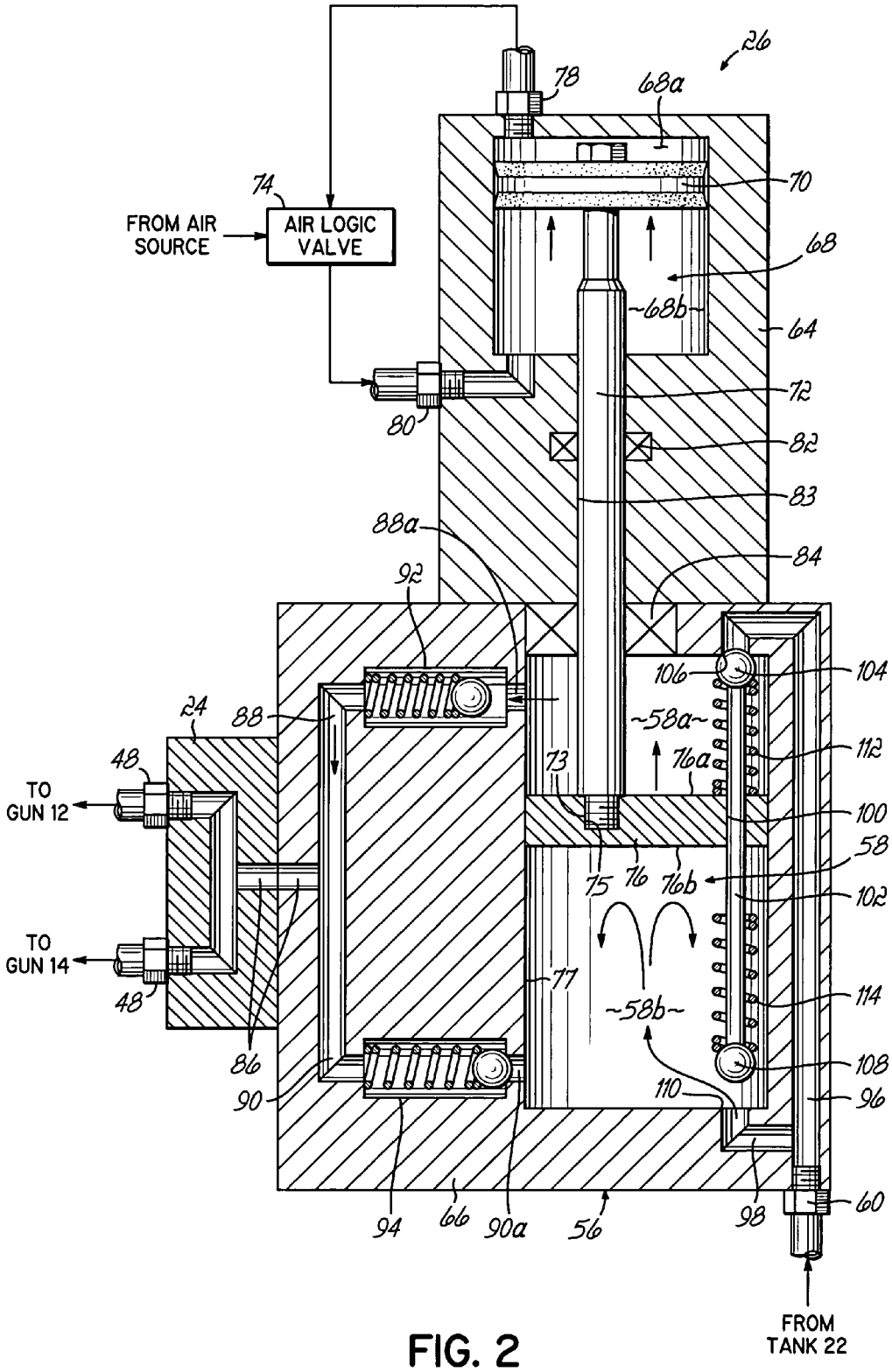
FIG. 2 is a diagrammatic sectional view of the pump manifold and pump of FIG. 1, partially fragmented and taken along line 2-2 of FIG. 1. to illustrate details of the pump during an upstroke portion of a dispensing cycle.

With reference to FIG. 2, pump 26 includes a pump housing 56 enclosing a pumping chamber 58, an inlet 60 coupling the tank 22 in fluid communication with the pumping chamber 58, and outlet ports 48 each in fluid communication with a corresponding one of the guns 12, 14. Pump 26 may include additional outlet ports 48 each coupled with gun 12, gun 14, or another gun (not shown). Generally, pump 26 moves liquid hot melt adhesive 18 from the inlet 60 to the outlet ports 48. An upper section 64 of housing 56 houses the pneumatic components of the pump 26 and a lower section 66 of housing 56 houses the hydraulic components of the pump 26.

The upper section 64 of the housing 56 includes an air cylinder 68, an air piston 70 disposed inside the air cylinder 68, and a pump shaft 72 extending from the air piston 70 to connect with a piston or plunger 76 positioned inside the pumping chamber 58. An air logic valve 74 regulates the air pressure supplied to the air cylinder 68 by alternatively filling and emptying air chambers 68*a,b* defined inside the air cylinder 68 on opposite sides of the air piston 70 for reciprocating the air piston 70 relative to the air cylinder 68. Air chamber 68*a* communicates with an air port 78 and, in a like manner, air chamber 68*b* communicates with an air port 80. Suitable fittings are used to connect ports 78, 80 with the air logic valve 74 having appropriate internal valving for supplying pressurized air to air chambers 68*a,b* to move air piston 70 and pump shaft 72.

Engaged with a blind threaded hole 75 defined in the plunger 76 is a threaded tip 73 of pump shaft 72. The threaded hole 75 is offset laterally from the center of plunger 76, although the present invention is not so limited. The present invention contemplates that the pump shaft 72 and plunger 76 may be coupled together in alternative fashions known to persons of ordinary skill in the art and is not limited to the illustrated threaded engagement.

Piston pump 26 pumps liquid hot melt adhesive 18 to the guns 12, 14 on both the upstroke and the downstroke. Reciprocation of the air piston 70 by cyclically filling and draining air chambers 68*a,b* moves the plunger 76 inside pumping chamber 58 for pumping successive volumes of the liquid hot melt adhesive 18 from the inlet 60 to the outlet ports 48, as detailed below. To that end, the periphery of plunger 76 has a close fit and tight clearance with an interior wall 77 of pumping chamber 58. Although the piston pump 26 is illustrated in FIG. 2 as bi-directional, the invention is not so limited. In particular, the piston pump 26 may be uni-directional and incorporate a return spring for shifting the air piston 70 on the downstroke. Other suitable actuation methods apparent to persons of ordinary skill in the art are contemplated by the invention.

Pump shaft 72 is positioned in a bore 83 with a clearance sufficient to permit reciprocating movement thereof. A seal 82 prevents pressurized air from leaking downwardly out of air cylinder 68 into the bore 83. Another seal 84, which is mounted within lower housing section 66, prevents pressurized liquid from escaping from the pumping chamber 58 of housing section 66 into bore 83. In effect, the seals 82, 84 isolate the pneumatic and hydraulic portions of the pump 26.

Movement of the air piston 70 and pump shaft 72 causes the plunger 76 to cyclically vary the volume of an upper section 58*a* and a lower section 58*b* of pumping chamber 58. Plunger 76 defines a barrier that segregates amounts of liquid hot melt adhesive 18 in the two sections 58*a*, 58*b*. Coupling the outlet ports 48 with upper and lower outlet passageways 88, 90 defined in the lower section 66 of housing 56 is an intermediate passageway 86 defined partially in lower housing 66 and partially in manifold 24. The outlet passageways 88, 90 converge at the intermediate passageway 86.

Figure 3:
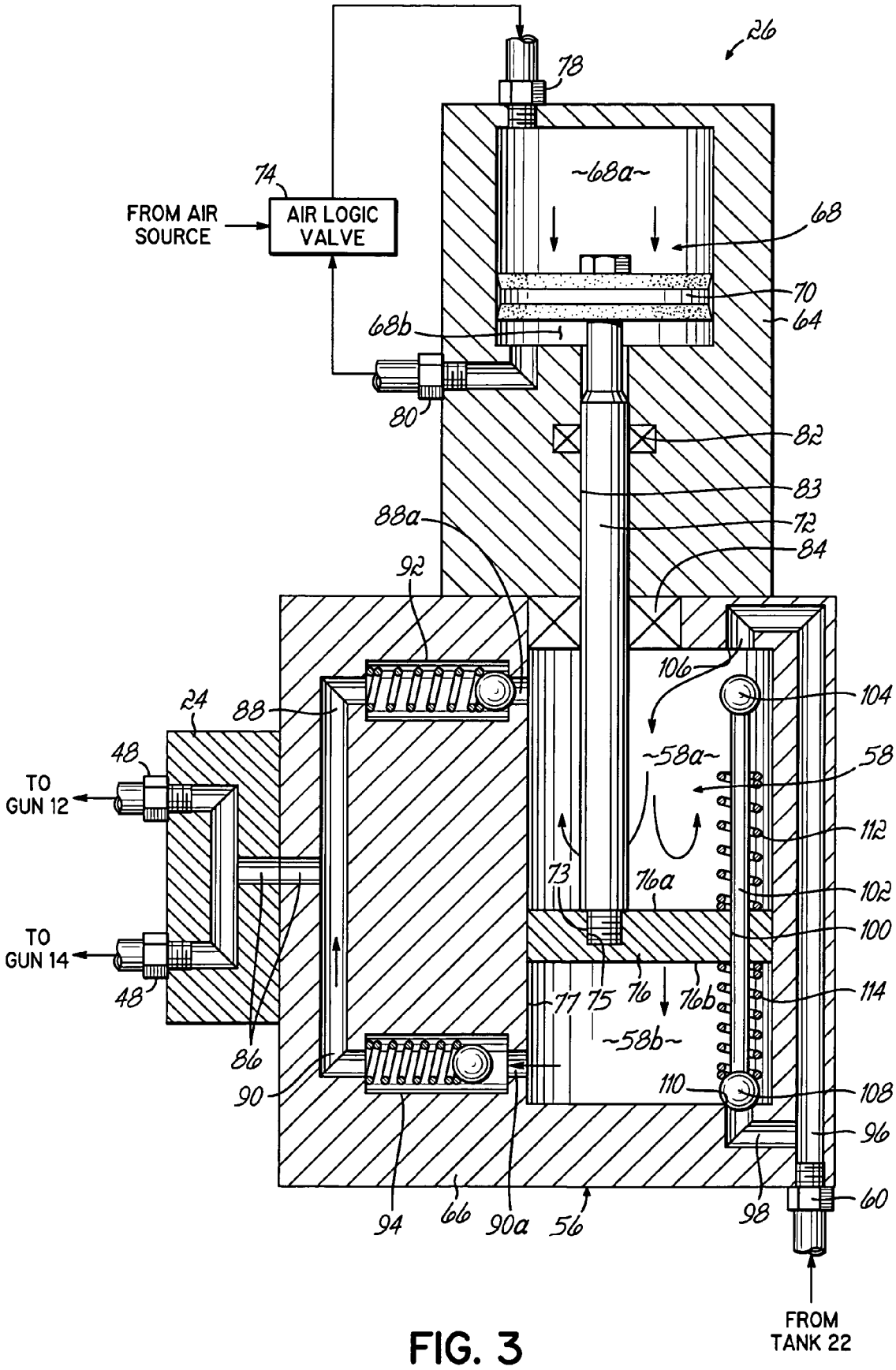
FIG. 3 is a view similar to FIG. 2 depicting the pump during a downstroke portion of the dispensing cycle.

Positioned in outlet passageway 88 is a check valve 92 and, similarly, a check valve 94 is located in outlet passageway 90. Check valve 94 prevents back flow from outlet passageway 90 into the lower section 58*b* of pumping chamber 58 during the upward stroke or upstroke of plunger 76, as shown in FIG. 2. Similarly, check valve 92 prevents back flow from outlet passageway 88 into the pumping chamber 58 during the downward stroke or downstroke of plunger 76, as shown in FIG. 3.

Check valves 92, 94 may be any suitable check valve that closes by fluid pressure to prevent return flow and that opens at a characteristic cracking pressure to permit forward flow in a desired direction. In the illustrated embodiment, each of the check valves 92, 94 is characterized by a valve seat and a compression spring that biases a valve body or ball against the valve seat. The pressure inside the upper and lower sections 58*a*, 58*b* of the pumping chamber 58 varies as the plunger 76 is reciprocated therein, which regulates the opening and closing of check valves 92, 94. Exemplary check valves 92, 94 suitable for use in the invention are available commercially from The Lee Company (Westbrook, Conn.). As an alternative to the check valve configuration detailed herein, other varieties of check valves may be utilized in the outlet passageways 88, 90 without affecting the operation principles of the piston pump 26.

Extending from the inlet 60 of pump housing 56 through the lower section 66 to the upper section 58*a* of the pumping chamber 58 is an inlet passageway 96. Branching from the inlet passageway 96 is another inlet passageway 98 that communicates with the lower section 58*b* of the pumping chamber 58. Successive volumes of liquid hot melt adhesive 18 are supplied from tank 22 through the inlet passageways 96, 98 to the pumping chamber 58 as the pump 26 operates.

The plunger 76 includes a throughbore 100 and a shaft 102 slidingly received in the throughbore 100 with a clearance sufficient to permit free vertical movement of shaft 102 within throughbore 100. The throughbore 100 is offset from the threaded opening 75 in plunger 76 by a distance sufficient to accommodate coupling pump shaft 72 with plunger 76 while simultaneously allowing unhindered vertical movement of shaft 102.

Affixed to, or otherwise associated for movement with, one free end of the shaft 102 is a ball or valve body 104. The alignment of shaft 102 for axial movement along its length within throughbore 100 and the positioning of valve body 104 on shaft 102 cooperate for engaging valve body 104 with a valve seat 106, which is defined at the intersection of inlet passageway 96 with the pumping chamber 58. The valve seat 106 coincides with the outlet from the inlet passageway 96.

Affixed to, or otherwise associated for movement with, the opposite free end of the shaft 102 is another ball or valve body 108 which is positioned on shaft 102 for engaging a valve seat 110. The valve seat 110 is defined at the intersection of the inlet passageway 98 with the pumping chamber 58 and coincides with the outlet from the inlet passageway 98. The valve seats 106, 110 may be located at other positions within the corresponding inlet passageways 96, 98, such as recessed within the passageways 96, 98 at the intersection with pumping chamber 58.

Compressed between the valve body 104 and an upper surface 76*a* of the plunger 76 is a biasing element, in the form of compression spring 112 having coils helical wrapped about a length of the shaft 102, that applies an upward resilient bias force to the shaft 102 and valve body 104 at least during a portion of the upstroke when valve body 104 is in contact with valve seat 106. Similarly, another biasing element, in the form of compression spring 114 having coils helical wrapped about another length of the shaft 102, compressed between the valve body 108 and a lower surface 76*b* of the plunger 76 applies a downward resilient bias force to the shaft 102 and valve body 108 at least during a portion of the downstroke when valve body 108 is in contact with valve seat 110.

Valve body 104 and spring 112 are positioned inside the upper section 58*a* of the pumping chamber 58. Valve body 108 and spring 114 are positioned inside the lower section 58*b* of the pumping chamber 58 and on an opposite side of plunger 76 from valve body 104 and spring 112. The shaft 102 extends through the space circumscribed by inside the helically-wound coils of the springs 112, 114, which prevents buckling or lateral deflection of the springs 112, 114 when compressed. The shaft 102, valve bodies 104, 108, valve seats 106, 110, and springs 112, 114 effectively replace conventional check valves found in the inlet passageways 96, 98 of conventional pumps used for pumping traditional hot melt adhesives.

The length of the shaft 102, the characteristics (e.g., length and spring constant) of springs 112, 114, and the range of motion of the plunger 76 are collectively chosen such that the valve body 104 has adequate clearance relative to valve seat 106 for entry of liquid hot melt adhesive 18 through inlet passageway 96 during the downward stroke of plunger 76 and valve body 108 has adequate clearance relative to valve seat 110 for entry of liquid hot melt adhesive 18 through inlet passageway 98 during the upward stroke of plunger 76. The length of shaft 102, the characteristics of springs 112, 114, and the range of motion of plunger 76 are also selected such that the valve bodies 104, 108 are engaged with the corresponding valve seats 106, 110 during the upward and downward strokes of plunger 76, respectively.

In operation and with reference to FIGS. 1-3, pump 26 of dispensing unit 16 continuously pumps liquid hot melt adhesive 18 from the inlet 60 to outlet ports 48 by orchestrated movements of plunger 76 caused by operation of the air logic valve 74 alternatingly filling and exhausting the air chambers 68*a*, 68*b*. This action moves the air piston 70 and pump shaft 72 at a rate suitable for causing the pump 26 to pump the liquid hot melt adhesive 18 from tank 22 to guns 12, 14.

At the bottom of the downstroke of plunger 76 as shown in FIG. 3, valve body 108 contacts valve seat 110 and is urged against the valve seat 110 by the biasing force applied by spring 114, which is compressed between the plunger 76 and valve body 108. The upper section 58*a* of pumping chamber 58 is occupied by an amount of liquid hot melt adhesive 18. The pump shaft 72 is poised to move upwardly, and both of the check valves 92, 94 are momentarily closed.

Pump shaft 72 moves upward when pressurized air is introduced into air chamber 68*b* under the control of air logic valve 74 and pressurized air is simultaneously exhausted from air chamber 68*a*. During this upward stroke or upstroke, as shown in FIG. 2, valve body 108 eventually lifts from contact with valve seat 110 as the biasing force applied by spring 114 to valve body 108 is gradually removed and the fluid pressure increases in inlet passageway 98 as the volume of lower section 58*b* expands. A gradual increase in the biasing force applied by spring 112 to valve body 104 may also contribute to lifting valve body 108 from contact with valve seat 110. This supplies additional force for lifting the valve body 108 from the valve seat 110. After valve body 108 is separated from valve seat 110, a fresh amount of liquid hot melt adhesive 18 flows through inlet 60 and through the inlet passageway 98 into the lower section 58*b* of pumping chamber 58.

The ball of check valve 92 is moved by the increasing fluid pressure in upper section 58*a* of pumping chamber 58 away from its seat to permit flow from the upper section 58*a* into the outlet passageway 88. Thus, an amount of liquid hot melt adhesive 18 inside the upper section 58*a* of pumping chamber 58 is forced into outlet passageway 88 as the volume of upper section 58*a* is reduced by upward movement of plunger 76. The amount of liquid hot melt adhesive 18 expelled from pumping chamber 58 is transferred through passageways 86, 88 to outlet ports 48, which in turn direct the pumped amount of liquid hot melt adhesive 18 to the guns 12, 14 through lines 20. The top of the plunger 76 at the conclusion of the upward stroke is preferably at a level at, or below, an inlet 88*a* to outlet passageway 88. Hence, the amount of liquid hot melt adhesive 18 pumped in the upstroke is substantially equal to the change in volume of the upper section 58*a* during the upstroke.

During the upward stroke of plunger 76, the ball of outlet check valve 94 is forced onto its seat by its spring and by the increased fluid pressure in outlet passageway 90. This blocks back flow from outlet passageway 90 into the lower section 58*b* of pumping chamber 58. Spring 112 is incrementally compressed between the plunger 76 and the valve body 104 as the plunger 76 moves upward.

At the top of the upward stroke, valve body 104 contacts valve seat 106 and is urged against the valve seat 106 by the biasing force applied by spring 112, which is compressed between the plunger 76 and the valve body 104. The lower section 58*b* of pumping chamber 58 is occupied by a fresh amount of liquid hot melt adhesive 18. The pump shaft 72 is poised to move downwardly, and both of the check valves 92, 94 are again momentarily closed.

As shown in FIG. 3 and as a continuation of the dispensing cycle, pump shaft 72 moves downward when pressurized air is simultaneously introduced into air chamber 68*a* and exhausted from air chamber 68*b*. During this downward stroke or downstroke, valve body 104 lifts from valve seat 106 due to the gradual removal of the biasing force applied to valve body 104 by spring 112, as spring 112 decompresses, in conjunction with the increased fluid pressure in inlet passageway 96 as the volume of upper section 58*a* expands. A gradual increase in the biasing force applied by spring 114 to valve body 108, as spring 114 is incrementally compressed between plunger 76 and valve body 108, may also contribute to lifting valve body 104 from contact with valve seat 106. This assists in lifting the valve body 104 from valve seat 106. After valve body 104 is separated from valve seat 106, a fresh amount of liquid hot melt adhesive 18 flows through inlet 60 and inlet passageway 96 into the upper section 58*a* of pumping chamber 58.

During the downstroke of plunger 76, the ball of check valve 92 is forced onto its seat by its spring and by the increased fluid pressure in outlet passageway 88. This prevents back flow from outlet passageway 88 into the lower section 58*b* of pumping chamber 58. Concurrently, the ball of outlet check valve 94 is moved by the increasing fluid pressure in upper section 58*a* of pumping chamber 58 away from its seat to permit flow from the lower section 58*b* into the outlet passageway 90. Thus, an amount of liquid hot melt adhesive 18 inside the lower section 58*b* of pumping chamber 58 is forced into outlet passageway 90 as the volume of lower section 58*b* is reduced by movement of plunger 76.

At the conclusion of the downward stroke, the bottom of the plunger 76 is preferably at a level at, or above, an inlet 90*a* to outlet passageway 90. Hence, the amount of liquid hot melt adhesive 18 pumped in the downstroke is substantially equal to the change in volume of the lower section 58*b* during the downstroke. The liquid hot melt adhesive 18 expelled from pumping chamber 58 is transferred through passageways 86, 90 to outlet ports 48, just as described above with respect to the upward stroke.

In this manner, successive fresh amounts of liquid hot melt adhesive 18 filling pumping chamber 58 are pumped by each dispensing cycle of pump 26, which consists of a single upward stroke of plunger 76 and a single downward stroke of plunger 76, to the guns 12, 14.

While the present invention has been illustrated by the description of various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A device for use in dispensing a liquid, the device comprising:

a pump housing having an inlet passageway with a valve seat, an outlet passageway, and a pumping chamber between said inlet passageway and said outlet passageway;

a piston slidably disposed within said pump housing for movement in a first direction for admitting an amount of the liquid into said pumping chamber through said inlet passageway and in a second direction for pumping the amount of the liquid from said pumping chamber through said outlet passageway, said piston including a throughbore aligned with said valve seat;

a shaft disposed in said throughbore for movement relative to said piston when said piston is moved in said first and second directions;

a check valve in said outlet passageway, said check valve having a movable body that is in a continuously spring-biased condition to control flow in said outlet passageway as said piston is moved in said first and second directions; and a valve body coupled with said piston, said valve body being disengaged from said valve seat to open said inlet passageway for admitting the amount of liquid into said pumping chamber when said piston is moved in said first direction and being engaged with said valve seat to close said inlet passageway when said piston is moved in said second direction.

2. The device of claim 1 further comprising:

a biasing element capable of resiliently biasing said valve body away from said valve seat when said piston is moved in said first direction.

3. The device of claim 1 further comprising:

a biasing element capable of resiliently biasing said valve body toward said valve seat when said piston is moved in said second direction.

4. The device of claim 3 wherein said biasing element is compressed between said piston and said valve body when said piston is moved in said second direction for engaging said valve body with said valve seat.

5. The device of claim 1 wherein said shaft includes first and second ends disposed on opposite sides of said piston and said valve body is affixed to said first end, said throughbore being aligned relative to said valve seat such that said valve body contacts said valve seat when said piston is moved in said second direction.

6. The device of claim 5 further comprising:

a first biasing element coupling said valve body with said piston, said first biasing element compressed between said piston and said valve body when said piston moves in said second direction for urging said valve body into contact with said valve seat; and a second biasing element coupling said second end of said shaft with said piston, said second biasing element capable of resiliently biasing said valve body away from said valve seat when said piston moves in said first direction.

7. The device of claim 6 wherein said first biasing element is a compression spring positioned between said valve body and said piston, said compression spring including a plurality of coils helically wrapped about said shaft.

8. The device of claim 1 wherein said shaft moves in said second direction when said piston moves in said second direction to disengage said valve body from said valve seat, and said shaft moves in said first direction when said piston moves in said first direction to engage said valve body with said valve seat.

9. A device for use in dispensing a liquid, the device comprising:

a pump housing having first and second inlet passageways each having a valve seat, first and second outlet passageways, a first pumping chamber between said first inlet passageway and said first outlet passageway, and a second pumping chamber between said second inlet passageway and said second outlet passageway;

a piston slidably disposed within said pump housing between said first and second pumping chambers, said piston movable in a first direction for admitting a first amount of the liquid into said first pumping chamber through said first valve seat and pumping a second amount of the liquid from said second pumping chamber into said second outlet passageway, and said piston movable in a second direction for pumping the first amount of the liquid in said first pumping chamber into said first outlet passageway and admitting the second amount of the liquid into said second pumping chamber through said second valve seat, said piston including a throughbore aligned with said valve seat;

a shaft disposed in said throughbore for movement relative to said piston when said piston is moved in said first and second directions;

a first valve body coupled with said piston, said first valve body being disengaged from said first valve seat to open said first inlet passageway for admitting the amount of liquid into said first pumping chamber when said piston is moved in said first direction and being engaged with said first valve seat to close said first inlet passageway when said piston is moved in said second direction;

a second valve body coupled with said piston, said second valve body being disengaged from said second valve seat to open said second inlet passageway for admitting the amount of liquid into said second pumping chamber when said piston is moved in the second direction and being engaged with said second valve seat to close said second inlet passageway when said piston is moved in said first direction;

a first check valve in said first outlet passageway, said first check valve having a movable body that is in a continuously spring-biased condition to control flow in said first outlet passageway as said piston is moved in said first and second directions; and a second check valve in said second outlet passageway, said second check valve having a movable body that is in a continuously spring-biased condition to control flow in said second outlet passageway as said piston is moved in said first and second directions.

10. The device of claim 9 further comprising:

a first biasing element capable of resiliently biasing said first valve body away from said first valve seat and said second valve body toward said second valve seat when said piston is moved in said first direction.

11. The device of claim 10 further comprising:

a second biasing element capable of resiliently biasing said second valve body away from said second valve seat and said first valve body toward said first valve seat when said piston is moved in said second direction.

12. The device of claim 11 further comprising:

a shaft coupled for movement relative to said piston when said piston is moved in said first and second directions, said first biasing element being compressed between said piston and said second valve body when said piston is moved in said first direction for engaging said second valve body with said second valve seat.

13. The pump of claim 12 wherein said second biasing element is compressed between said piston and said first valve body when said piston is moved in said second direction for engaging said first valve body with said first valve seat.

14. The device of claim 13 wherein said first biasing element includes a first plurality of coils helically wrapped about a first length of said shaft and said second biasing element includes a second plurality of coils helically wrapped about a second length of said shaft.

15. The device of claim 12 wherein said shaft moves in said first direction when said piston moves in said first direction to disengage said first valve body from said first valve seat, and said shaft moves in said second direction when said piston moves in said second direction to disengage said second valve body from said second valve seat.

* * * * *